United States Patent [19]

Reiner et al.

[11] 4,094,081

[45] June 13, 1978

[54] BEACH SANDAL

[76] Inventors: Joseph Reiner, 30 Sutton Pl.; Kenneth Vigluicci, 103 Crest Rd.; Michael Reiner, 30 Sutton Pl., all of Toms River, N.J. 08753

[21] Appl. No.: 786,745

[22] Filed: Apr. 11, 1977

[51] Int. Cl.[2] ..... A43B 5/04

[52] U.S. Cl. ..... 36/116; 36/11.5

[58] Field of Search ..... 36/116, 122, 11.5, 7.5

[56] References Cited

U.S. PATENT DOCUMENTS

| | | | |
|---|---|---|---|
| 683,595 | 10/1901 | Drouillard | 36/116 |
| 2,193,943 | 3/1940 | Shea | 36/11.5 |
| 3,082,548 | 3/1963 | Hartman | 36/116 |
| 3,758,891 | 9/1973 | Geister | 36/7.5 |

*Primary Examiner*—Patrick D. Lawson
*Attorney, Agent, or Firm*—Allison C. Collard

[57] ABSTRACT

A beach shoe or sandal for walking on sandy or porous surfaces, comprising a flat sole surface in the general shape of the user's foot, which has a projecting, peripheral wall, formed perpendicular to the sole surface that terminates in a flat rim for contact with the sand. The projecting wall defines a cavity in the bottom surface of the sole, so that the sand becomes compacted when walked upon by the user. Suitable straps are secured to the top of the sole surface, for coupling to the user's foot.

1 Claim, 3 Drawing Figures

BEACH SANDAL

This invention relates to an improved beach sandal for walking on porous or sandy surfaces.

More specifically, this invention relates to a beach sandal, having a compression-forming sole for contact with porous or sandy surfaces.

Beach sandals are generally constructed with flat or ribbed soles for walking on hard or soft beach surfaces, and including straps for gripping the sandal to the user's foot. One of the disadvantages of walking on a sandy surface with a flat-soled shoe is that the sand gives way under the pressure of the foot, so that an additional effort has to be exerted by the user in walking across a sandy beach. The weight of the user's foot can never be evenly distributed across the entire sole surface, but it either applied to the heel or the toe area, which causes the sand to displace away from the point of pressure.

Accordingly, the present invention provides an improvement over conventional beach sandals, wherein a compression cavity or chamber is formed in the sole of the beach shoe, so that there is a minimal amount of displacement of the sand, due to its compaction, when the user traverses the surface wearing these sandals. The sandals include a peripheral rim, which defines a recessed area within their soles, and conventional straps for securing the sandal to the user's foot.

It is therefore an object, according to the present invention, to provide an improved beach sandal, which forms a compression chamber in contact with soft or sand surfaces.

It is another object, according to the present invention, to provide an improved beach sandal, which is simple in design, easy to manufacture and reliable in operation.

Other objects and features of the present invention will become apparent from the following detailed description considered in connection with the accompanying drawing, which discloses the embodiments of the invention.

In the drawing, wherein similar reference characters denote similar elements throughout the several views.

Figure 1:
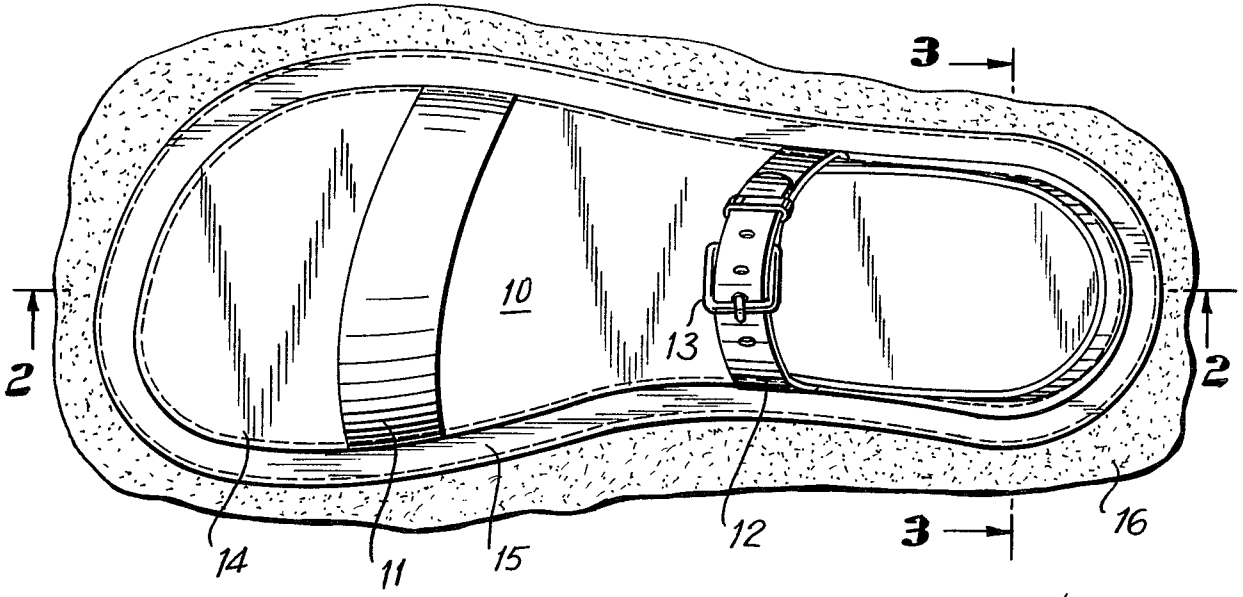
FIG. 1 is a top plan view of the beach sandal, according to the present invention.
Figure 3:
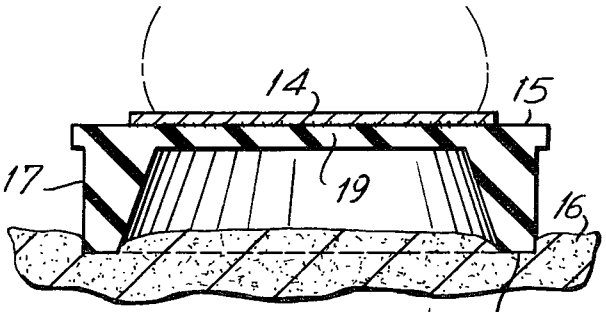
FIG. 3 is a cross-sectional view, taken along section 3—3 of FIG. 1.
Figure 2:
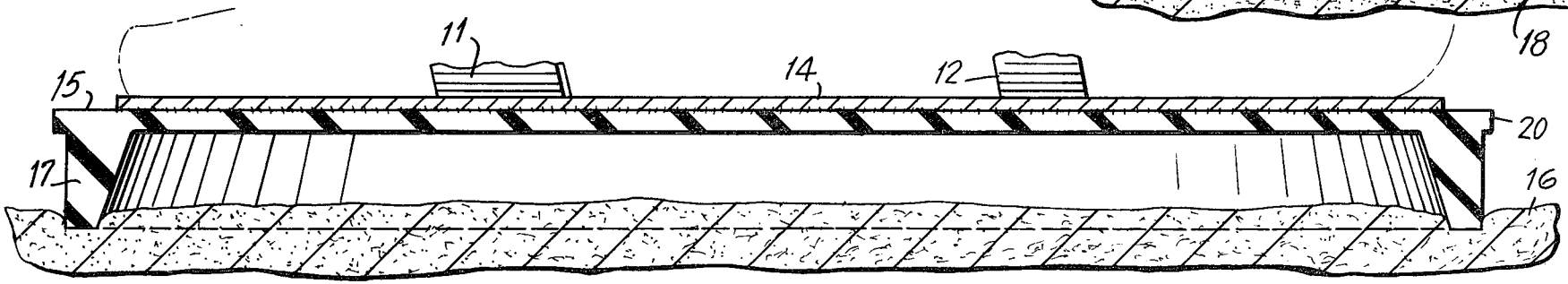
FIG. 2 is a cross-sectional view, taken along section 2—2 of FIG. 1.

Referring to FIG. 1–3, there is shown a beach sandal or shoe 10, having a first strap 11 for fitting over the user's toe area, and a second, adjustable ankle strap 12, including a buckle 13, with suitable holes in the strap as is well known in the art. Both of these straps are secured to a liner 14, which is attached to the sole 15 of the shoe. The sole is preferably constructed of a resilient material, such as rubber or plastic, and includes a tapered, peripheral edge 17, terminating in a flat rim 18, to define a closed chamber when in contact with a sand surface 16. As shown in detail in FIGS. 2 and 3, when sole 15 is applied to a sand surface, the flat rim 18 sinks slightly below the sand surface, so that a small amount of sand enters the cavity of the sole. A pressure is immediately established within the cavity of the sole, which is evenly distributed across the entire length of the foot, so that the entire area of the sole is exerting the same pressure to the sand surface. Therefore, there is no uneven distribution of weight or any uneven displacement of sand, as the person walks on the sand surface, using the beach sandal of the present invention.

The average pressure that a person's foot exerts on a ground surface while walking, is approximately 15 pounds per square inch. This average pressure is exerted when, for example, a person's heel is lifted off the ground and the ball of his foot is pressing on the ground surface. If, however, a person stands still, so that the surface of the entire foot is in contact with the ground, then the pressure exerted by a person's foot, can be as low as 5 pounds per square inch. In the present invention, where the entire weight of the person's body is distributed across the sole of the foot, a pressure of approximately 5 pounds per square inch, is exerted on the sand surface, and this pressure is sufficient to support the person without any undue displacement of the sand while the person walks. It has thus been found that the beach shoe of the present invention improves a person's ability to walk across a sand surface at a faster rate, with much less effort expended.

In the present invention, straps 11 and 12 are preferably constructed of leather or other flexible material, and connected to a leather or flexible fabric material 14, which is secured to the sole by means of adhesive or rivets. The sole is preferably an integrally-formed plastic material, but could also be constructed of rubber or any resilient material commonly used for shoe soles. Flat rib surfaces 18 in contact with the sand, can be made to vary, depending on whether women's or men's shoes are used. The height of the peripheral walls 17 should be sufficient, so that the normal sandy surfaces, no sand will come into contact with surface 19 of the sole. The peripheral walls 17 are preferably wedge-shaped, or tapered as shown, to add strength to their integral connection with flat surface 19 of the sole. The thickness of surface 19 is adjusted, so as to give strength to support the weight of the user without being unduly massive or heavy, when being utilized for walking. A platform edge 20 can also be provided to add to the top surface width of the shoe.

While only a single embodiment of the present invention has been shown and described, it will be obvious that many changes and modifications may be made thereunto without departing from the spirit and scope of the invention.

What is claimed is:

1. A beach shoe for walking on sand surfaces, comprising:

a non-pivotable, flat sole surface in the general shape of the user's foot;

a continuous wall projecting substantially perpendicular to the sole surface and integrally-formed therewith and extending about and adjacent to the periphery of said surface, said wall terminating in a flat rim for contact with the sand and defining an unobstructed cavity in the bottom surface of the sole extending from the toe to the heel section of said sole, said peripheral wall being tapered from its widest portion adjacent to said sole surface, to its narrowest portion in contact with the sand surface, the depth of said cavity, defined by said projecting wall surface, being sufficient to prevent the bottom of said sole surface from contracting; and means on the top of the sole surface for securing the sole to the user's foot, said means including a foot pad secured to the top of said sole surface, a first strap coupled to said foot pad for engagement over the toes of the user, and a second strap having a buckle-and-belt arrangement for securement over the user's ankle.

* * * * *